United States Patent [19]

Inoue

[11] 4,364,802

[45] Dec. 21, 1982

[54] SCANNING ELECTRODE VIBRATION ELECTRODEPOSITION METHOD

[75] Inventor: Kiyoshi Inoue, Tokyo, Japan

[73] Assignee: Inoue-Japax Research Incorporated, Yokohama, Japan

[21] Appl. No.: 240,919

[22] Filed: Mar. 5, 1981

[51] Int. Cl.[3] ..... C25D 5/04

[52] U.S. Cl. ..... 204/23; 204/25

[58] Field of Search ..... 204/23, 25, 26, 14 R

[56] References Cited

U.S. PATENT DOCUMENTS

| | | | |
|---|---|---|---|
| 4,269,672 | 5/1981 | Inoue | 204/23 |
| 4,290,856 | 9/1981 | Inoue | 204/4 |

FOREIGN PATENT DOCUMENTS

| | | |
|---|---|---|
| 805291 | 12/1953 | United Kingdom . |
| 748485 | 5/1956 | United Kingdom . |
| 892416 | 3/1962 | United Kingdom . |
| 1060753 | 3/1967 | United Kingdom . |
| 1121193 | 7/1968 | United Kingdom . |
| 1212873 | 11/1970 | United Kingdom . |
| 2014611 | 8/1979 | United Kingdom . |
| 2032320 | 5/1980 | United Kingdom . |
| 2061793 | 5/1981 | United Kingdom . |

*Primary Examiner*—T. Tufariello

*Attorney, Agent, or Firm*—Karl F. Ross

[57] ABSTRACT

An electrodeposition method and apparatus, particularly suitable for electrodeposition of a substrate of large area and intricate contour, uses an electrode having a small electrode area adapted to be spacedly juxtaposed with a portion of the substrate to define a small electrodeposition gap flushed with a stream of liquid electrolyte. High-frequency and small mechanical vibrations are imparted to the electrode while an electrodeposition current, preferably in the form of pulses, is passed between the electrode and the workpiece, which are relatively displaced by a drive unit to cause the electrode area to sweep three-dimensionally over a selected surface area of the substrate, thereby forming a layer of the electrodeposition thereon of a desired uniform thickness with an increased rate. The electrode is preferably constituted as an electrode assembly comprising an electromechanical transducer, a horn and the electrode attached in sequence. Drive means responds to a numerical controller to produce a three-dimensional displacement between the electrode assembly and the substrate. An automatic electrode changing unit is associated with the numerical controller for successively bringing a plurality of different electrodes into electrodeposition positions to act on successive surface regions of the contoured substrate.

20 Claims, 1 Drawing Figure

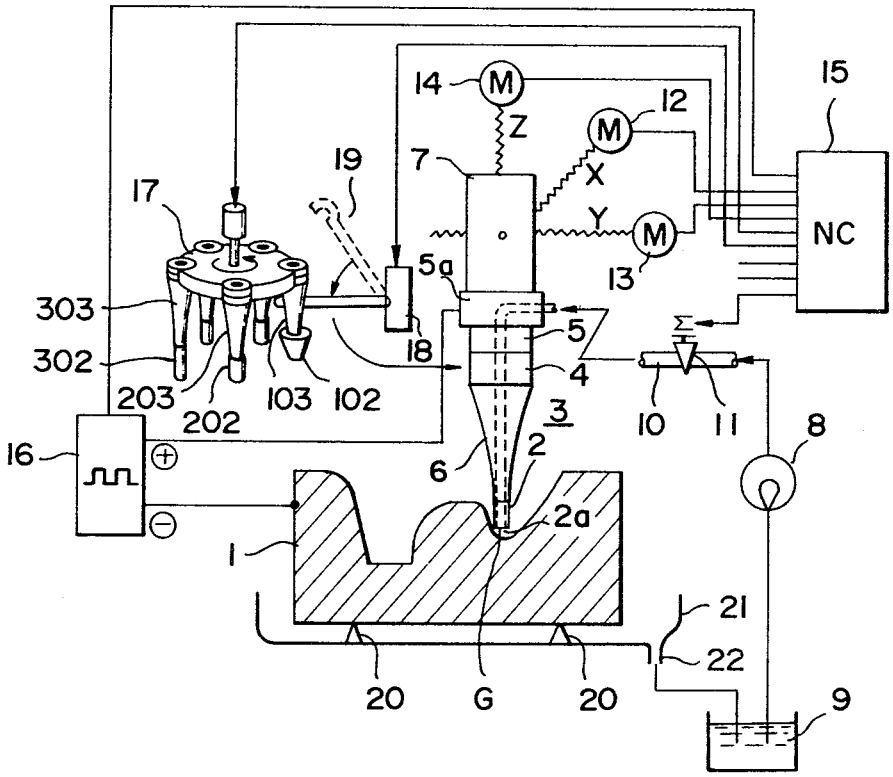
14
M
Z
12
M
15
7
19
X
17
Y
M
NC
5a
13
303
5
18
302
4
203
202
103
102
3
10
11
8
16
2
6
2a
1
21
22
20
G
20
9

SCANNING ELECTRODE VIBRATION ELECTRODEPOSITION METHOD

FIELD OF THE INVENTION

The present invention relates to electrodeposition and, more particularly, to a new and useful method of and apparatus for electrodeposition on a substrate, e.g. a workpiece or a mold.

BACKGROUND OF THE INVENTION

Electrodeposition techniques which have hitherto been practiced on the commercial basis make common use of a bath of liquid electrolyte in which a substrate to be electrodeposited is immersed. An electric potential is applied between the cathodic substrate and an anodic electrode which is fixedly spaced apart from the substrate over a substantial distance. An electric current is caused to flow from the anode to the substrate on which a metal is electrolytically deposited. In these techniques, the anode assembly commonly has a planar electrode surface with a substantial area confronting the substrate irrespective of the general configuration of the latter and the electrode arrangement remains stationary during a given electrodepositing operation.

While various proposals were made in the art in an effort to generally improve the electrodeposition process, it has been recognized that substantially all of them are more or less incomplete and have left much desired as regards the rate of deposition and its uniformity over a desired surface as well as its operational stability, especially where the surface is large in area and/or has an intricate contour.

OBJECTS OF THE INVENTION

It is accordingly a principal object of the present invention to provide an electrodepositing method whereby a substrate of a large area and/or an intricate surface contour can be electrodeposited upon with an improved efficiency over the prior art.

Another important object of the invention is to provide an electrodepositing method which allows a substrate to be electrodeposited with an increased uniformity over its entire areas desired.

Still another important object of the invention is to provide a method of electrodepositing on a surface of a large area and/or intricate surface contour which enables the operation to continue with an enhanced stability.

A further object of the invention is to provide an electrodepositing apparatus for carrying out the method described.

Yet another object of the invention is to provide an electrodepositing apparatus which is efficient in operation and allows a desired operation of electrodepositing a substrate of a large area and/or intricate contour to be performed on a fully automatic basis.

SUMMARY OF THE INVENTION

In accordance with the present invention, in a firstaspect thereof, there is provided an electrodepositing method which comrpises, spacedly juxtaposing a substrate with an electrode having relatively small electrode area in the region thereof confronting the substrate to define a small electrodeposition gap therebetween, flushing the electrodeposition gap with a liquid electrolyte; passing an electric current through the gap between the electrode and the substrate to electrodeposit a metallic substance from the electrolyte onto the substrate; imparting high-frequency mechanical vibrations to the electrode; and relatively displacing the electrode and the substrate to cause the electrode area to sweep over at least a selected surface area of the substrate, thereby forming thereon a layer of the electrodeposition of a predetermined thickness. The electrodeposition gap may be of a size between 0.01 and 5 mm. It has been found that better results are obtainable when the size ranges not greater than 1 mm and preferably not greater than 0.5 mm. The frequency of the vibrations imparted to the electrode may range between 50 Hz and 1 MHz but should preferably range between 1 and 500 kHz. The amplitude of the mechanical vibrations may range between 0.01 and 5 mm but should range preferably not greater than 1 mm and yet preferably not greater than 0.5 mm. The mechanical vibrations may have a low-frequency component of a frequency ranging between 50 and 500 Hz and a high-frequency component of a frequency between 1 kHz and 500 kHz.

In accordance with a further specific feature of the invention, the electrodeposition current is preferably applied in the form of a succession of electric pulses. The pulses may be provided in synchronism with the mechanical vibrations imparted to the electrode so that each instant the electrode comes closest to the substrate, each of the pulses is passed through the electrodeposition gap. In this case, each of the pulses should preferably be applied in the form of a train of elementary pulses each of which has an extremely short duration, say between 1 and 5 microseconds. Alternatively, it has been found to be advantageous to have the electrodeposition pulses passed at a range of repetition slightly greater than the frequency of the mechanical vibrations.

In accordance with another important specific feature of the present invention, the electrode is constituted as a portion of an electrode assembly including an electromechanical transducer and a horn body attached at its region of greater cross section to the transducer and at its region of smaller cross section to the electrode. The electromechanical transducer is energized by a power supply, i.e. of a desired frequency of the mechanical vibrations, to produce the mechanical oscillatory signals which are amplified by and propagated through the horn body. The horn body thus provides the mechanical vibrations of a desired frequency and amplitude which is imparted to the electrode. As a result, the effective surface area of the electrode is forced to be driven forth and back with the high frequency and the small amplitude desired.

The invention is particularly advantageous for electrodeposition upon a substrate of a large area and intricate contour. Thus, in accordance with yet another important feature of the invention, the gap spacing defined between the small electrode area and the substrate is maintained substantially constant while the vibrating electrode and the substrate are relatively displaced to cause the electrode area to sweep over the surface of the substrate. The sweeping operation is performed with the aid of a numerical controller operating on the basis of preprogrammed data describing predetermined sweeping paths on the substrate or a copying arrangement with a sensing head following a model prepared to duplicate the substrate.

By virtue of the novel features of the invention, a highly activated condition develops at the electrodeposition gap and provides an extremely high current density which allows a desired metal to be electrodeposited at an increased rate to form a layer of enhanced quality. Deposition is allowed to build up with an increased uniformity over a desired area on the substrate of intricate contour. It has been found that a rate of deposition increased to two or five times over the prior art, using an arrangement previously described, is attained with the present invention. The deposited layer has been shown to possess an extremely fine crystal structure of deposited metal and an extremely high elongation. The layer is uniformly continuous from one site to another on the intricate contour, even from a projected area to a deep cavity portion thereon.

Greater effectiveness is achieved, in accordance with a further feature of the invention, by using a plurality of different electrodes or electrode assemblies carrying different electrodes preselected for a plurality of surface areas of the substrate of a large area and intricate contour. Each of the electrodes should have an electrode arear whose geometrical characteristic is preselected in conjunction with each of the surface areas for electrodeposition therewith. Thus, by successively using these electrodes, the layer of electrodeposition is uniformly extended over an entire desired area of the substrate.

Upon the layer of electrodeposition achieving a given uniform thickness, the thickness of this layer can be further increased in accordance with another feature of the invention. This can be attained conveniently by juxtaposing the electrodeposited substrate of intricate contour with a planar electrode having an electrode area greater than that of a previously used electrode confronting the substrate to define a large gap therebetween which may be much greater than the previous electrodeposition gap in the presence of the liquid electrolyte and passing an electric current through the large gap to electrodeposit the metallic substance from the liquid electrolyte onto the previously electrodeposited substrate. The invention is applicable practically with any metal such as nickel, chromium copper, gold or platinum.

The present invention provides, in a second aspect thereof, an apparatus for electodeposition of a substrate, comprising: an electrode having a relatively small electrode area adapted to be spacedly juxtaposed with a portion of the substrate to define a small electrodeposition gap of a size not greater 5 mm therebetween; means for flushing the machining gap with a stream of a liquid electrolyte; power supply means for passing an electric current through the gap between the electrode and the substrate to electrodeposit a metallic substance from the liquid electrolyte onto the substrate; vibrator means for imparting high-frequency mechanical vibrations of a frequency between 50 Hz and 1 MHz to the electrode; and drive means for relatively displacing the electrode and the substrate to cause the electrode area to sweep over at least a selected surface area of the substrate, thereby forming thereon an electrodeposited layer of the predetermined uniform thickness.

The power supply preferably comprises a DC source and circuit means for pulsing the output of the DC source to produce a succession of pulses constituting the electric current, the pulses having a rate of repetition between 50 Hz and 1 MHz. Means may be connected with the power supply and said vibrator means for synchronizing the electrodeposition pulses with the mechanical vibrations imparted to the electrode.

The drive means may include first and second drive units for relatively displacing the electrode and the workpiece along two mutually orthogonal axes, e.g. along an X-axis and Y-axis and thus in an X-Y plane, to cause the electrode area to sweep two-dimensionally over the selected area of the substrate and a third drive unit for relatively displacing the electrode and the substrate along a third axis, e.g. the Z-axis, orthogonal to the first and second axes or in the axis of the electrode or electrode assembly to maintain the size of the electrodeposition gap substantially constant. The drive means is advantageously operated by a numerical controller on the basis of preprogrammed data to actuate the first, second and third drive units so as to cause the electrode area to sweep three-dimensionally over the selected area of the substrate while maintaining the gap spacing therebetween substantially constant.

In accordance with a further feature of this aspect of the invention, the apparative is provided with an automatic electrode changing unit, preferably operated by the numerical controller. The automatic electrode changing unit may include magazine means for storing a plurality of different electrodes or electrode assemblies carrying different electrodes which are prepared respectively for a plurality of particular surface areas of a substrate, especially when the substrate has a large area and an intricate contour. Each electrode should have a particular electrode area whose geometrical characteristic is determined in conjunction with the particular geometrical characteristic of a respective selected surface area on the substrate. The automatic electrode changing unit should then include actuator means operated by the numerical controller to withdraw one electrode used for one particular surface area on the substrate, to act on the magazine means and replace the one electrode by another electrode for use with another particular surface area.

The numerical controller may further be adapted to act on the power supply means and/or means for supplying the liquid electrolyte to the electrodeposition gap. Thus, one or both of the parameters of the electrodeposition current and the rate of flow or pressure of the liquid electrolyte into the electrodeposition gap may be varied in a sequence of steps so as to be optimum for electrodeposition of the successive surface areas on the substrate.

BRIEF DESCRIPTION OF DRAWING

These and other objects, features and advantages of the present invention will become more readily apparent from the following description as taken with the accompanying drawing in which the sole FIGURE is a schematic view partly in section and partly in perspective diagrammatically illustrating a certain exemplary form of the electrodeposition apparatus according to the invention.

SPECIFIC DESCRIPTION

In the FIGURE, a substrate constituted by a workpiece or a mold for electrodeposition (hereinafter referred to as mold unless otherwise indicated) is designated at 1. The mold 1 is shown having an intricate contour with projecting portions and deep cavities which has been known in the art to be extremely difficult to electrodeposit with uniformity. The mold 1 can also be considered to be extremely large. An electrodeposition electrode 2 has a small effective electrode area *2a* spacedly juxtaposed with the mold 1 to define an electrodeposition gap G therewith as small as 0.01 to 5 mm, preferably less than 1 mm and yet preferably not greater than 0.5 mm. The electrode area 2a is thus capable of entry into a narrowest cavity region on the mold. The electrode 2 is shown constituted as a portion of an electrode assembly 3 comprising an electromechanical transducer 4 secured to a support member 5 and a horn body 6. The horn 6 is attached at its end of greater cross section to the transducer 4 and at its end of smaller cross section to the electrode 2. The transducer 4 may be composed of quartz and is energized by a high-frequency power supply (not shown) to produce high-frequency mechanical oscillatory signals therein which are amplified by and transmitted via the horn body 5. The intensified high-frequency mechanical vibrations are thus provided by the horn body 5 and imparted to the electrode 2. As a result, the electrode surface area 2a is forced to be driven towards and away from the mold 1 surface at the high-frequency. The frequency of the vibrations is adjusted in the range between 50 Hz and 1 MHz and, preferably, between 1 and 100 kHz. The amplitude of the vibrations is set in the range between 0.01 and 5 mm, preferably not in excess of 1 mm and yet preferably up to 0.5 mm.

The electrode assembly 3 comprising the electrode 2, the horn 5, the transducer 4 and the support member 5 is coupled via an attachment 6 to a head 7. The attachment 6, the support member 5, the transducer 4, the horn 5 and the electrode 2 have bores which communicate from one to the next to conduct and supply under pressure a liquid electrolyte drawn by a pump 8 from a reservoir 9 and furnished through a conduit 10. The latter is provided with a valve 11 adjustable to control the pressure of liquid electrolyte or its rate of flow into the electrodeposition gap G.

The head 7 is driven by three motors 12, 13 and 14 operable in response to drive signals furnished from a numerical controller 15. The motor 12 is operated to move the head 7, hence the electrode 2 along an X-axis orthogonal to the axis thereof. The motor 13 is operated to move the electrode 2 along a Y-axis orthogonal to the X-axis and to the axis of the electrode 2, i.e. to the axis of the assembly 3 or the head 7. The motor 14 is operated to move the electrode 2 along a Z-axis i.e. along the axis of the head 7, the assembly 3 and the electrode 2. The numerical controller 15 has input data describing the contour of the mold 1 and paths of displacement of the electrode 2 or electrode area 2a to follow, with the gap spacing G, the contour of the mold 1. In operation of the electrodeposition apparatus described, the data stored in the numerical controller 15 are reproduced and converted to drive pulses which are input to the motors 12, 13 and 14 to displace the head 7 so that the electrode area 2a precisely follows, with a predetermined gap spacing G, the contour of the mold 1 or sweeps over the latter surface.

An electrodeposition power supply 16 has a positive terminal electrically connected to the electrode 2 and a negative terminal electrocally connected to the mold 1 or to a conductive layer applied thereon when the mold itself is nonconductive. An electric current is thus caused to flow between the electrode 2 and the mold 1 through the small gap G flooded with the liquid electrolyte to electrolytically deposit a metal from the electrolyte onto the area on the mold 1 juxtaposed with the electrode area 2a. The power supply 16 is preferably a pulse generator adapted to provide a succession of electric pulses of a frequency or rate of repetition ranging between 50 Hz and 1 MHz preferably between 1 kHz and 500 kHz. The pulse generator may comprise a DC source and a power switch connected in series with the DC source and the electrodeposition gap G. The power switch may be operated by an oscillator furnishing time bases of the electrodeposition pulses and the DC source may be adjusted of its output voltage and current to control the peak voltage and current of the electrodeposition pulses. A synchronizing circuit may be connected to the oscillator and the power supply for the electromechanical transducer 4 to synchronize the electrodeposition pulses with the vibrational signals. The result is that each instant the electrode area 2a comes closest to the surface of the mold 1, one of the electrode position pulses is passed through the electrodeposition gap G. In this case, it has been found to be advantageous to provide each of the pulses in the form of elementary pulses of an extremely short duration, say, 1 to 5 microseconds. It has been found to be generally preferred to set the electrodeposition pulses at a frequency slightly greater than the frequency of the mechanical vibrations imparted to the electrode 2.

In accordance with a further important feature of the invention, a plurality of electrodes are used to electrodeposit the contoured surface of the mold 1. These electrodes are designated at 102, 202, 302 . . . and supported in electrode assemblies 103, 203, 303 . . . which are attached to a disk 17 constituting an electrode storage magazine. The electrodes 102, 202, 302 . . . have electrode surfaces with different configurations preselected for particular configurations of divided areas of the contoured surface of the mold 1 to be electrodeposited. The electrode assemblies 103, 203, 303 . . . carrying these different electrodes are releasably mounted on the disk 17 which is rotatable about its shaft in response to a signal furnished from the numerical controller 15. An actuator 18 also operable by the numerical controller 15 has an arm 19 which can swing between the electrode storage magazine 17 and a position below the head 7. Each electrode assembly 103, 203, 303 . . . and the head 7 may contain an attachment structure of any known design, e.g. an electromagnetic holder arrangement, which permits each electrode to be secured to or released from the head 7.

The numerical controller 15 has input data describing a sequence of steps defined corresponding to successive surface areas to be encountered by a predetermined path of sweeping displacement effected relatively between the electrode head 7 and the mold 1 and also input data describing selection of particular electrodes and hence the particular electrode assemblies supporting them. These input data are reproduced in the actions of the electrode storage magazine 17 and the actuator unit 18. Thus, each time a signal is provided by the numerical controller 15 indicating a completion of the electrodeposition of one predetermined area of the mold 1 by one preselected electrode, the actuator 18 is operated to bring the arm 19 into engagement with this electrode assembly and to return it to the magazine 17 for storage thereon. The disk 17 is then rotated by an angle commanded by the numerical controller 15 to bring an electrode assembly carrying a next desired electrode for engagement by the arm 19. The actuator 18 is then operated by a signal from the numerical controller 15 to cause a grip member of the arm 18 to grapple this electrode assembly. A further signal from the numerical controller to the actuator 18 causes the arm 19 to swing and thus to move this electrode assembly to the position below the head 7 and to permit the electrode assembly to be attached to the head 7. The actuator 18 is then operated to return the arm 19 to the location of the magazine 17 to allow the electrodeposition operation to recommence with the replaced electrode.

In this mode of operation as well, one or both of the power supply 16 and the valve 11 may be controlled by signals furnished from the numerical controller 15. Thus, optimum parameter valves of the electrodeposition power and/or optimum pressures or rates of flow of the liquid electrolyte into the gap G for electrodeposition over successive surface areas of the mold 1 in conjunction with the particular shapes and areas of the electrodes used may be preprogrammed in the numerical controller 15 and are reproduced in the actual operation of the apparatus to control the power supply 16 and/or the valve 11 as well. The parameters of the mechanical vibrations imparted to the electrode 2, i.e. the frequency and amplitude thereof, may also be controlled by the numerical controller 15. Furthermore, the numerical controller 15 may be associated with a microcomputer and a gap sensor. The microcomputer has memorized therein various settings for the power supply 16, the valve 11 and the motor 14 corresponding to varying gap conditions, respectively. The gap sensor may be connected with the electrodeposition gap G to derive from the latter one or more gap variables. The computer responds to these gap variables to monitor the gap state and to determine in which one of the preselected classes the gap state falls and then to establish a particular one of the memorized settings corresponding to the particular gap state ascertained. The parameter resetting operation continues at selected time intervals for a given course of the electrodepositing operation.

The mold 1 is supported securely on a base 20 in a worktank 21. The worktank 21 has a sufficient wall height so that the mold is completely immersed in the liquid electrolyte collected therein. The liquid electrolyte in the worktank 21 is conducted via an outlet 22 for return to the reservoir 9.

The electrodes 102, 202, 302 . . . stored in their respective assemblies 103, 203, 303 . . . on the disk or magazine 17 may have electrode surfaces of various shapes and areas, (e.g. thin, thick, long and short); preselected for the various shapes and areas of the surface regions of the mold 1 to be successively electrodeposited. For example, a thin and elongated electrode may be used for a deep and small cavity. Rectangular, rounded and conical electrodes may be used for rectangular, rounded and conical cavities, respectively.

The high-frequency and small mechanical vibrations imparted to the electrode 2 provide a highly activated condition in the small electrodeposition gap formed between the small electrode surface 2*a* and the mold 1 and traversed by a forced flow of the liquid electrolyte. An enhanced pumping action and agitation are provided for the liquid electrolyte continuously flushed into the gap to facilitate removal of gaseous and other decomposition products from the small gap area. The ionic contaminents and oxide products as well which tend to be formed on the electrode and mold surfaces are thereby broken and carried away with the forced flow of the liquid electrolyte. Since the electrode surfaces are thus maintained under the extremely active condition, the peak current can be much increased to increase the current density to an unparalleled level. Specifically, it has been found to be possible to have a current denisty increased to as much as 0.5 to 5 amperes/cm$^2$ which can be maintained for an extended period of time, thus assuring an enhanced rate of deposition and operational stability. It has been shown that a layer of electrodeposition that results has a crystalline formation of an increased fineness and density and is of excellent quality. Furthermore, by causing the electrode area to sweep over the successive surface areas of the mold while maintaining with stability the extremely activated gap condition achieved by the electrode vibration, a uniform layer of electrodeposition can be extended to cover the entire surface area of the mold.

Once the continuous electrodeposited layer of a predetermined thickness is achieved, the thickness of this layer may be increased by continuing the electrodepositing operation in a known manner. Thus, for example, a planar electrode with a large electrode area is juxtaposed across a large distance with the electrodeposited mold while an electric current is passed between the electrode and the mold. The metal is electrodeposited from the liquid electrolyte onto the previously electrodeposited surface of the mold.

There are thus provided a new and useful electrodeposition method and apparatus which are particularly advantageous for forming a uniform layer of electrodeposition on a substrate of large and/or intricate contour.

What is claimed is:

1. A method of electrodeposition, comprising the steps of:

spacedly juxtaposing a substrate with an electrode having a relatively small area in the region thereof confronting said substrate to define a small electrodeposition gap therebetween;

flushing said electrodeposition gap with a liquid electrolyte;

passing an electric current through said gap between said electrode and said substrate to electrodeposit a metallic substance from said liquid electrolyte onto said substrate;

imparting high-frequency mechanical vibrations to said electrode; and relatively displacing said electrode and said substrate to cause said electrode area to sweep over at least a selected surface area of said substrate, thereby forming thereon a layer of the electrodeposition of a predetermined thickness.

2. The method defined in claim 1 wherein said electrodeposition gap is of a size not greater than 1 mm.

3. The method defined in claim 2 wherein said size is not greater than 0.5 mm.

4. The method defined in claim 1 wherein said vibrations are of a frequency between 50 Hz and 1 MHz.

5. The method defined in claim 4 wherein said frequency is between 1 kHz and 500 kHz.

6. The method defined in claim 4 or claim 5 wherein said mechanical vibrations are of an amplitude not greater than 1 mm.

7. The method defined in claim 6 wherein said vibrations is not greater than 0.5 mm.

8. The method defined in claim 4 wherein said mechanical vibrations have a low-frequency component of a frequency between 50 and 500 Hz and a high-frequency component of a frequency between 1 kHz and 500 kHz superimposed thereon.

9. The method defined in claim 5 wherein said electric current is in the form of a succession of pulses.

10. The method defined in claim 9 wherein said pulses are produced in synchronism with said mechanical vibrations so that each instant said electrode comes closest to said substrate during each stroke of said mechanical vibrations, each of said pulses is passed through said electrodeposition gap.

11. The method defined in claim 9 or claim 10 wherein each of said pulses is in the form of a train of elementary pulses.

12. The method defined in claim 9 wherein the frequency of said pulses is slightly greater than the frequency of said mechanical vibrations.

13. The method defined in claim 1 wherein said electrode is a portion of an electrode assembly including an electromechanical transducer energized by a power supply for producing mechanical oscillatory signals therein and a horn body attached at its portion of greater cross section to said transducer and at its portion of smaller cross section to said electrode for transmitting said mechanical oscillatory signals to said electrode, thereby providing said mechanical vibrations.

14. The method defined in claim 1 wherein said substrate has an intricate surface contour and said gap spacing is maintained substantially constant while said electrode and said substrate are relatively displaced.

15. The method defined in claim 1 using a plurality of such electrodes for a plurality of such surface areas of said substrate of an intricate contour, each of said electrode having an electrode area with a geometrical characteristic preselected in conjunction with a geometrical characteristic of each of said surface areas for electrodeposition therewith to extend said layer of electrodeposition over an entire area of said substrate.

16. The method defined in claim 15, further comprising, upon forming each layer of electrodeposition on each of said surface areas, replacing the one of said electrodes which was used therefor by another of said electrodes which is preselected for a next of said surface areas to be electrodeposited.

17. The method defined in claim 13 using a plurality of such electrode assemblies for a plurality of such surface areas of said substrate of an intricate contour, each of said assemblies carrying such an electrode having an electrode area with a geometrical characteristic preselected in conjunction with a geometrical characteristic of each of said surface areas for electrodeposition therewith to extend said layer of electrodeposition over an entire area of said substrate.

18. The method defined in claim 17, further comprising, upon forming each layer of electrodeposition on each of said surface areas, replacing the one of said electrode assemblies which was used therefor by another of said electrode assemblies which is preselected for a next of said surface areas to be electrodeposited.

19. The method defined in claim 16 or claim 18, further comprising the step of increasing the thickness of said layer electrodeposited over said entire region of said substrate by juxtaposing said electrodeposited substrate of intricate contour with a planar electrode having an electrode area greater than said relatively small area confronting said substrate to define a large gap therebetween which is much greater than said electrodeposition gap in the presence of said liquid electrolyte; and passing an electric current through said large gap to electrodeposit said metallic substance from said liquid electrolyte onto the previously electrodeposited substrate.

20. The method defined in claim 1 wherein said metallic substance is a metal selected from the group which consists of nickel, chronium, copper, gold and platinum.

* * * * *